United States Patent [19]

Irvin, Jr.

[11] 4,269,160

[45] May 26, 1981

[54] IGNITION DEVICE FOR INTERNAL COMBUSTION ENGINE

[76] Inventor: Eugene Irvin, Jr., 522 Winchester, Richardson, Tex. 75080

[21] Appl. No.: 10,330

[22] Filed: Feb. 8, 1979

[51] Int. Cl.[3] ..... F02M 27/04

[52] U.S. Cl. ..... 123/620; 123/595

[58] Field of Search ..... 123/148 E, 148 AC, 148 A, 123/148 R, 148 DC

[56] References Cited

U.S. PATENT DOCUMENTS

| | | | |
|---|---|---|---|
| 2,451,482 | 10/1948 | Flint | 123/148 DC |
| 2,799,792 | 7/1957 | Flint | 123/148 AC |
| 3,019,276 | 1/1962 | Harlow | 123/148 A |
| 3,613,653 | 10/1971 | Irvin, Jr. et al. | 123/148 A |
| 3,949,718 | 4/1976 | Turner | 123/148 AC |

*Primary Examiner*—P. S. Lall

*Attorney, Agent, or Firm*—H. Mathews Garland

[57] ABSTRACT

A device for improving the ignition characteristic of an internal combustion engine and reducing the air pollutants discharged by such engine having electrical apparatus for applying an electrostatic charge into the combustion chambers of the engine including a pair of electrical energy conductors, and an induction block connected with the conductors for each of the spark plug wires of the engine each induction block having a longitudinal channel sized to receive a spark plug wire, a retainer for holding the block on the spark plug wire, first and second longitudinally spaced chambers partially encircling the spark plug wire channel in electrical insulated relationship from the channel, first and second electrically conductive plates positioned in the first and second chambers partially encircling the spark plug wire channel, conductive clamping means on each of the plates connecting each plate with one of the pair of conductors between the induction blocks, and removable cover means for holding the pair of electrical conductors with each induction block clamping the first and second plates in the first and second chambers of each block. One such induction block is installed on each spark plug wire of the engine. Current flowing to each firing cylinder of the engine induces an electrical potential in the plates of the induction block on the firing wire which potential on each plate is communicated to the corresponding plate of the induction block on the non-firing spark plug wires inducing an electrostatic potential on the plates around the non-firing spark plug wires to communicate the electrical potential into the non-firing cylinders improving the combustibility of the fuel in such cylinders.

12 Claims, 17 Drawing Figures

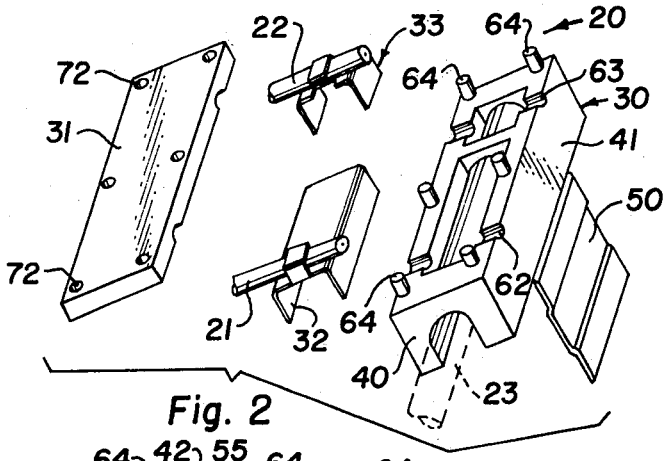
Fig. 2
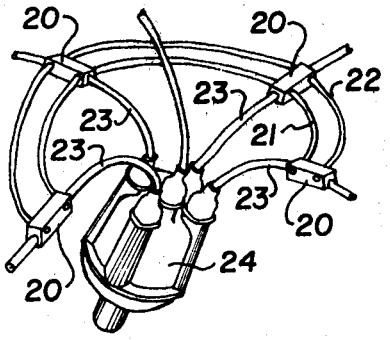
Fig. 1
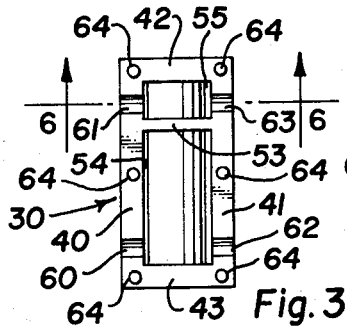
Fig. 3
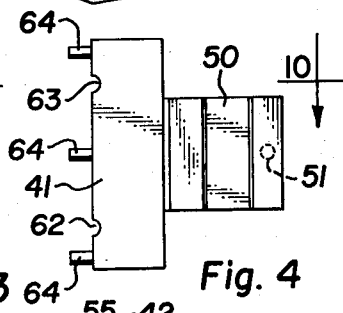
Fig. 4
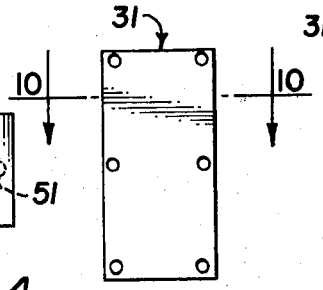
Fig. 8
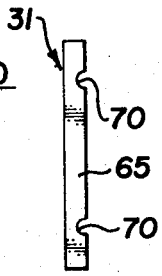
Fig. 11
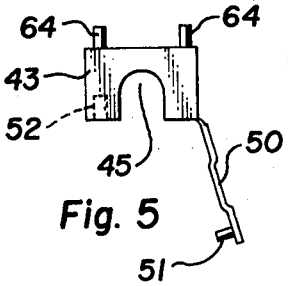
Fig. 5
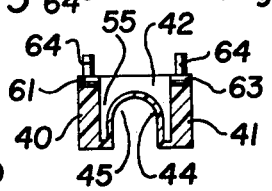
Fig. 6
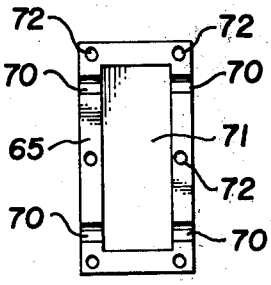
Fig. 9
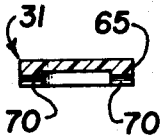
Fig. 10
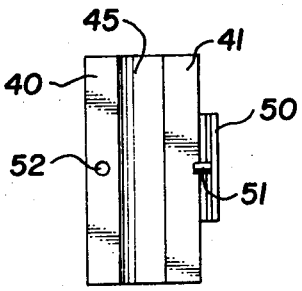
Fig. 7
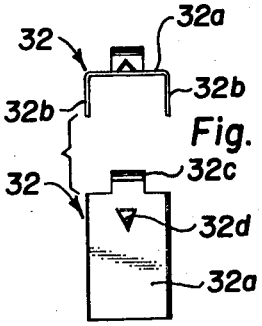
Fig. 12
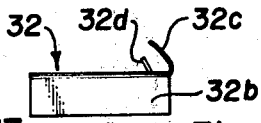
Fig. 13
Fig. 14
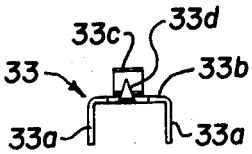
Fig. 16
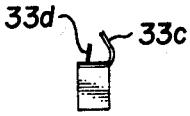
Fig. 17
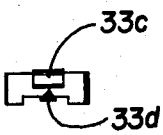
Fig. 15

IGNITION DEVICE FOR INTERNAL COMBUSTION ENGINE

This invention relates to an internal combustion engine emission device and more particularly to an ignition device for electrically enhancing the combustion process of an internal combustion engine.

In recent years both air pollution and fuel shortage problems have become major obstacles to the continued operation of internal combustion engines for vehicle and other uses as they are presently structured and operated. One of the principal reasons for the both the production of pollutants by the internal combustion engine and the inefficiency of utilization of the fuel by the engine is the inefficiency of the combustion process in the cylinders of the engine resulting in the discharge of many unburned or only partially burned products which, for the most part, are gaseous in nature so that they add further impurities to the air.

It has been found that a non-igniting electrical condition can be developed in each of the non-firing cylinders of an internal combustion engine responsive to the flow of current to the firing cylinder thereby improving conditions for combustion in the non-firing cylinders. The flow of current to each of the firing cylinders is utilized to inductively create a potential providing a field in each of the non-firing cylinders which effects conditions in such cylinders which improve combustion. Several different approaches have been made to utilize this particular electrical concept but in many instances they have fallen somewhat short of achieving the desired end result and in particular have not been commercially desirable as they interfered or altered the existing structure of the ignition system of the internal combustion engine and/or required somewhat more than ordinary skill for installation. One particular prior art device which has utilized the same principles of the present invention successfully is disclosed and claimed in U.S. Pat. No. 3,613,653 issued Oct. 19, 1971 to Eugene Irvin, Jr., the present inventor, and Edmond A. Carrell. The particular mechanical structure disclosed in such patent for connecting the device with the spark plug wires of an engine is not operable with some more recently developed distributors. Also it has been found that the present invention is capable of developing a potential at the non-firing cylinders of approximately 40% greater than that of the device shown in the patent.

It is, therefore, a particularly important object of the present invention to provide a new and improved ignition device for an internal combustion engine for reducing air pollution and improving the fuel efficiency of the engine.

It is another object of the invention to provide a new and improved ignition device of the character described which may be installed by an unskilled person without altering the existing structure of the engine ignition system.

It is another object of the invention to provide a new and improved ignition device of the character described which creates a more homogenous mixture of air and fuel to provide a smoother burning mixture in each cylinder of the engine.

It is another object of the invention to provide a new and improved ignition device which breaks down solid deposits on the piston and cylinder surfaces exposed to the combustion process.

It is a further object of the invention to provide an ignition device which improves the power output of an engine and thus increases the gas mileage of an automobile by increasing the efficiency of the combustion process.

It is a further object of the invention to provide an ignition device which increases the acceleration of an engine.

It is a further object of the invention to provide an ignition device which reduces oil contamination of an engine.

It is a further object of the invention to provide an ignition device wherein the atmosphere in each engine is ionized thereby lowering the voltage required to provide an igniting spark across the gap of each spark plug of the engine.

It is a further object of the invention to provide an ignition device which includes no moving parts and thus is not subject to wear.

It is a still further object of the invention to provide an ignition device which is not affected by humidity and various forms of contamination or other conditions normally detrimental to the proper performance to spark plugs and other components of the ignition system of an internal combustion engine.

It is a further object of the invention to improve the life of the various components of the ignition system of the engine including the battery by reducing the voltage necessary to operate the ignition system.

It is a further object of the invention to provide an ignition device which may be readily assembled to fit any desired number of cylinders of an engine.

It is a further object of the invention to provide an ignition device which may be installed without the use of special tools or particular technical knowledge of the ignition system of the engine.

It is a further object of the invention to provide an ignition device which is connected between the normal spark plug leads of the ignition system of the engine whereby the device is energized by current flowing to each of the spark plugs of the engine.

It is a further object of the invention to provide an ignition device of the character described which does not require that the insulation of the spark plug leads be penetrated for connection of the device.

It is a still further object of the invention to provide an ignition device which improves the idle speed of the engine.

In accordance with the invention, there is provided an ignition device for an internal combustion engine which includes a plurality of induction blocks interconnected by a pair of electrical conductors connecting in parallel condenser plates in each of the induction blocks supported in spaced relation around the spark plug wire on which each of the inductions blocks is mounted. Each of the induction blocks has a longitudinal channel which receives a spark plug wire and first and second electrically conductive plates mounted in spaced relation to and partially encircling the spark plug wire channel. The plates are supported in the block in longitudinal spaced relation. The first plates of each of the blocks are clamped to and electrically connected with a first of the conductors interconnecting the blocks. A second of the plates in each of the induction blocks is secured to and electrically connected with the second of the conductors between the induction blocks. Current flowing in the spark plug wire to the firing cylinder induces an electrical potential in the first and second plates of the induction block on such spark plug wire. The electrical potential is conducted through the first and second conductors to the remaining induction blocks supported on the spark plug wires to the non-firing cylinders. The plates partially surrounding the spark plug wires to the non-firing cylinders induce an electrical potential in each such spark plug wires which is communicated to the spark plug of the non-firing cylinders creating an electrical condition in such non-firing cylinders which enhances combustion in such cylinders when fired.

The foregoing objects and advantages of the invention will be better understood from the following detailed description of a preferred embodiment of the invention taken in conjunction with the accompanying drawings wherein:

FIG. 1 is a fragmentary assembly view in perspective showing the ignition device of the invention assembled on the spark plug wires of a four cylinder engine;

FIG. 2 is an exploded perspective view of one of the ignition block assemblies of the device of the invention;

FIG. 3 is a top plan view of the induction block assembly housing;

FIG. 4 is a side view in elevation taken at 90° to the right of FIG. 3 of the induction block assembly housing;

FIG. 5 is an end view of the induction block assembly housing as viewed from the end of the housing nearest the reader in FIG. 2;

FIG. 6 is a view in section of the induction block assembly housing along the line 6—6 of FIG. 3;

FIG. 7 is a bottom view of the induction block assembly housing;

FIG. 8 is a top view of the cover plate for the induction block assembly housing;

FIG. 9 is an inside or bottom view of the cover plate of FIG. 8;

FIG. 10 is a view in section along the line 10—10 of FIG. 8;

FIG. 11 is a right edge view of the housing cover plate as seen in FIG. 8;

FIG. 12 is a top view of the large electrically conductive plate of the induction block assembly showing the conductor tab and conductor point of the plate lying in the same plane as the top of the plate for better illustrating the shape of the tab and point;

FIG. 13 is an end view of the plate of FIG. 12 showing the tab and point bent upwardly to positions at which the plate is clamped in electrically conductive relationship with the electrical conductor;

FIG. 14 is a right side view of the plate as shown in FIG. 13;

FIG. 15 is a top view of the small electrically conductive plate of the induction block assembly showing the conductor clamp tab and contact point folded into the plane of the top of the plate for better illustrating the shape of the tab and point;

FIG. 16 is an end view of the plate of FIG. 15 showing the conductor clamp tab and contact point bent upwardly at the position for securing the plate in electrically conductive relationship with a conductor; and FIG. 17 is a right side view of the small plate as shown in FIG. 16.

Referring to FIG. 1, the ignition device of the invention includes a plurality of induction block assemblies 20 which are interconnected by first and second conductors 21 and 22 and are each clamped on a separate one of spark plug wires 23 leading from a distributor 24 to the spark plugs, not shown, of an internal combustion engine, not shown. In accordance with the invention, the current flowing from the distributor to each firing cylinder is utilized to inductively create an electrical condition in the spark plug wires leading to the non-firing cylinders where an electrical condition is induced which is non-igniting and creates a cylinder atmosphere more favorable to a highly efficient combustion process. The exact phenomenon which occurs in the cylinder to enhance the cylinder atmosphere is not known, though it is believed to be in part a corona effect induced by the voltage at the sparking gap of the non-firing plugs communicated from the spark plug wire leading to the firing cylinder at the time current flows in such wire from the distributor to the spark plug of the firing cylinder.

Referring to FIG. 2, each of the induction block assemblies 20 includes a housing 30, a housing cover 31, a first large conductive plate 32, and a second small conductive plate 33.

The details of the housing 30 are shown in FIGS. 3–6 inclusive. The housing has longitudinal side walls 40 and 41 joined with opposite end walls 42 and 43. A semi-elliptical longitudinal partition 44 extends along a longitudinal axis between the end walls defining a downwardly opening semi-elliptical conductor channel 45 for receiving a spark plug wire 23. A retainer plate 50 is formed integral with and hinged to the bottom edge of the side wall 41. The inside face of the retainer plate is provided with a locking pin 51 positioned perpendicular to the plane of the plate along the free edge of the plate. The pin 51 is insertable into a locking bore 52 formed in the side wall 40 of the housing opening downwardly through the bottom edge of the side wall. The retainer plate 50 folds across the bottom of the housing so that the free inside edge of the plate rests against the bottom edge of the housing side wall 40 clamping the housing on a spark plug wire 23 extending through the channel 45. The housing 30 has a cross partition 53 which runs parallel with the end walls 42 and 43 extending across the housing between the side walls above the semi-elliptical partition 44 having a top edge in the same plane as the top edges of the end walls 42 and 43. The partition 53 is located substantially closer to the end wall 42 than to the end wall 43 so that the partition 53 defines a first upwardly opening large chamber 54 between the partition 53 and the end wall 43 and a second smaller upwardly opening chamber 55 between the partition 53 and the end wall 42. The cross partition 53 extends between the side walls 40 and 41 of the housing to the top surface of the longitudinal partition 44. The first large chamber 54 is designed to receive the first large plate 32 permitting the plate to partially encompass the longitudinal partition 44 within the chamber. The second smaller chamber 55 is designed to receive the second small plate 33 so that the plate partially encompasses the longitudinal partition 44 within the second small chamber. The first side wall 40 is provided along the top edge thereof with a semi-circular channel 60 leading into the first large chamber 54 and with a second semi-circular channel 61 leading to the second smaller chamber 55. Similarly, the other side wall 41 is provided along the top edge thereof with a semi-circular channel 62 aligned with the channel 60 also leading into the first chamber 54 and with a semi-circular channel 63 aligned with the channel 61 leading to the second smaller chamber 55. The channels 60 and 62 permit the first conductor 21 to pass through the first chamber 54 and the channels 61 and 63 permit the second conductor 22 to pass through the second chamber 55. The top edge surfaces of the side and end walls of the housing are provided with mounting pins 64 located at the four corners of the housing and at the midpoints of the side walls for holding the top 31 on the housing.

The housing top 31 is rectangular in shape and is sized to fit over the housing 30 on the top edges of the end and side walls of the housing. The bottom face of the top has a peripheral flange 65 having side wall portions which are provided with semi-circular recesses 70 aligned in pairs toward the opposite ends of the top to register with the pairs of semi-circular channels 60 and 62 and 61 and 63, respectively, to accommodate the two conductors 21 and 22 so that the conductors may pass through the housing for connection with the plates 32 and 33, respectively. The inside face 71 of the top 31 within the peripheral flange 65 defines the top or ceiling of the first and second chambers 54 and 55 providing space for the entrance and exit of the conductors 21 and 22 and the connection of the conductors with the plates 32 and 33 along the top of the first and second chambers. The top is provided with bores or holes 72 positioned at the four corners of the top and at the center line of the top along the side edges of the flange 65 to register with the six mounting pins 64 on the housing body for connecting the top 31 on the housing body 30. The pins 64 and the holes 72 are sized to permit a tight fit of the pins in the holes for holding the top on the housing.

The housing 30 and the top 31 of the distribution block assembly are constructed of an electrically insulating material such as a plastic which may be quickly and inexpensively fabricated. The housing and top are each one piece integral units which are molded in accordance with standard plastic fabricating procedures.

The first conductive sleeve 32 which may be considered analagous to a condenser plate as illustrated in FIGS. 12–14 is an open-sided rectangular shaped channel member having a central or top plate portion 32*a* and parallel side walls 32*b*. The plate 32 is sized to fit within the first large chamber 54 so that the side plate portions 32*b* extend down along the opposite sides of the longitudinal channel member 44 while the top plate portion 32*a* extends across the top portion of the partition 44. The shape of the plate 32 permits the plate to effectively encompass approximately one-half of the spark plug wire 23 positioned within the channel 45 of the induction block housing 30. Formed integral with the top portion 32*a* of the plate 32 are a rectangular retainer tab 32*c* fixed along a bottom edge of the tab with the plate top portion and a triangular conductor contact point 32*d* which is formed from the material of the top portion 32*a* by making two connected angular cuts in the top portion so that the contact point 32*b* may be bent upwardly as evident in FIGS. 13 and 14. The retainer tab 32*c* is designed to be bent partially around the conductor 21 to pinch the conductor between the tab and the top surface of the channel portion 32*a* for tightly securing the conductor 21 with the plate 32. The contact point 32*d* is shaped and positioned to pierce the insulation on the conductor 21 for making electrically conductive contact with the conductive wire in the conductor so that electrical communication is established between the plat and the conductive wire through the conductor 21.

The smaller second electrically conductive plate 33, as illustrated in FIGS. 15–17, is a rectangular open-sided channel-shaped member having side leg portions 33*a* formed on a top portion 33*b*. The plate 33 is sized to fit within the smaller distribution block assembly housing chamber 55 so that the plate side portions 33*a* extend along the sides of the longitudinal partition 44 within the chamber 55 and the top portion 33*b* of the plate extend across the top portion of the partition within the chamber. The top portion 33*b* of the plate has a rectangular conductor retainer tab 33*c* formed integral with the top portion of the plate and connected with the top portion along an edge of the tab. Extending in longitudinal alignment with the tab 33*c* is a conductor point 33*d* which also is formed integral with the plate top portion 33*b*. The tab 33*c* is designed to bend around to pinch the conductor 22 between the tab and the top face of the plate portion 33*b* while the point 33*d* pierces the insulation of the conductor to contact the conductive wire through the center of the conductor 22 to effect electrical connection between the wire in the conductor 22 and the plate 33.

The plates 32 and 33 are made of an electrically conductive material which may be economically manufactured and bent to form the connections between the conductors and the plates. A suitable material for the plates has been found to be brass.

A complete ignition device incorporating the features of the invention includes one ignition block assembly for each of the spark plug wires of the engine on which the device is to be used. As indicated in FIG. 1 the induction block assemblies are connected on the conductors 21 and 22 at spaced intervals along the lengths of the conductors to properly position the induction block assemblies for coupling on the spark plug wires 23. Two of the induction block assemblies are secured respectively at opposite ends of the conductors 21 and 22 with the remaining induction block assemblies being connected in spaced relation between such opposite ends for convenient securing on the spark plug wires. The first of the conductors 21 is electrically connected between the first plates 32 in all of the induction block assemblies so that the plates may be considered as electrically connected in parallel. Similarly the second smaller plates 33 of the induction block assemblies are connected with the second conductor 22 so that the plates 33 are considered as electrically connected in parallel. The electrical system forming the first conductor 21 and the plates 32 is in insulated relationship from the electrical system comprising the conductor 22 and the plates 33. Each of the induction block assemblies 20 is connected together and coupled with the first and second conductors 21 and 22 in the general relationship as illustrated in FIG. 2. The first larger plate 32 is connected on the conductor 21 by forcing the conductor downwardly on the contact point 32*d* until the contact point pierces the insulation of the conductor and is forced into the conductor engaging the conductive wire along the center of the conductor. The retainer tab 32*c* is then bent partially around the conductor insulation to trap or pinch the conductor on the contact point 32*d* between the inside face of the tab 32*c* and the top face of the plate portion 32*a*. The plate is thus tightly secured in electrically conductive relationship with the conductor. Similarly the smaller plate 33 is connected with the conductor 22 by pressing the conductor 22 downwardly on the contact point 33*d* until the contact point pierces the insulation and engages the conductive wire through the conductor and the tab 33*c* is bent partially around the conductor to clamp the plate with the conductor in electrically conducting relationship. The large plate 32 is then placed in the large first chamber 54 of the induction block assembly housing 30. The side leg portions 32*b* of the plate 32 fit downwardly on opposite sides of the housing longitudinal partition 44. Similarly the plate 33 is placed in the smaller housing chamber 55 with the leg portions 33*a* of the plate fitting downwardly along opposite sides of the partition 44 within the chamber. Thus, the large and small first and second plates partially encompass the partition 44 within the large and small chambers respectively. The top 31 is then placed on the pins 64 and pressed tightly downwardly closing the induction block assembly housing. The conductors 21 and 22 enter the chambers of the housing through the semi-circular recesses or channels provided in the top edges of the housing side walls and the internal flange 65 of the top 31. On those induction block assemblies which are on the opposite ends of the conductors 21 and 22 the conductors simply extend through the channel openings along one side of the induction block assembly housing. In those induction block assemblies that are intermediate the ends of the conductors 21 and 22 the conductors pass into the block assembly housings at one side of the housing and pass outwardly toward the next block assembly through the opposite side of the housing and housing top.

After connection of the induction block assemblies on the conductors 21 and 22 the ignition device is secured on the ignition system of an internal combustion engine, not shown, in the relationship shown in FIG. 1. One of the end induction block assemblies is first connected on a convenient one of the spark plug wires by placing the induction block assembly housing on the wire approximatly two inches fron the distributor 24 with the spark plug wire 23 fitted along the housing assembly channel 45 so that the spark plug wire passes completely through the housing longitudinally along the channel. This, of course, is done with the retainer 50 open as illustrated in FIG. 2. The hinged retainer 50 is then folded upwardly toward the housing to a closed position across the open bottom of the channel 45 inserting the retainer pin 51 of the retainer 50 into the hole 52 along the bottom edge of the side wall 40 of the housing. The pin 51 is sized in relation to the hole 52 so that the retainer 50 snaps into a closed locked relationship across the bottom of the retainer housing tightly holding the retainer housing on the spark plug wire. Each of the succeeding induction block assemblies is connected on succeeding spark plug wires until the entire ignition device is coupled with the spark plug wires. One induction block assembly is connected with each of the separate spark plug wires.

Prior to installing the ignition device on the ignition system of an internal combustion engine the engine should be in normal good running order. The carburetor should be adjusted for a normal mixture setting. The spark plug wires and distributor should be in good condition. Upon completion of installation and during the operation of the device on the engine, the induction block assemblies should at all times be securely attached to the spark plug wires. After the engine has been run approximately one thousand miles with the ignition device installed, the oil of the engine should be changed, the oil filter should be changed, and the idle speed of the engine should be adjusted to normal.

With the ignition device connected between and electrically coupling the spark plug leads between the distributor and the spark plugs, as the distributor sequentially energizes each of the spark plug leads the ignition device is activated transmitting a non-igniting electrical condition from each energized spark plug lead to the remaining non-energized spark plug leads and thus to the non-firing cylinders of the engine. As the current flows in the energized spark plug lead the flow of the current through the first and second conductive plates 32 and 33 produces an electrical potential on each of the plates due to an electrical field around the spark plug wire. The character of the material forming the induction block assembly housing and the spacing between the electrically conductive first and second plates and the energized spark plug wire preclude any sparking effect between the wire and the plates. Also the electrical relationship between the plates and the wire is not such that there is any damage to the insulation on the spark plug wire. The electrical potential developed on each of the plates 32 and 33 is conducted through the contact points on the plates to the conductors 21 and 22 leading to the other induction block assembly on the remaining non-energized spark plug wires. Thus, an electrical potential is developed on the first and second conductive plates 32 and 33 in each of the other induction block assemblies. Such potential on the plates induces an electrical condition in the non-energized spark plug wires which is conducted through such wires to the non-energized spark plugs. Such condition is communicatd through the spark plugs into the non-firing cylinders resulting in a low level non-igniting electrical emission from such non-firing plugs. These non-igniting electrical conditions in the non-firing cylinders preconditions the fuel charge and the atmosphere within the non-firing cylinders to enhance the combustion process in such cylinders so that when each of the spark plugs in such cylinders is subsequently energized to ignite the fuel charge in the cylinders the combustion process is improved. As the engine operates in routine fashion with the spark plugs being sequentially fired, the ignition device of the invention effects the desired fuel charge preconditioning in each of the non-igniting cylinders prior to and as each spark plug lead is sequentially energized by the distributor.

The numerous previously discussed beneficial effects are obtained, including improved acceleration, increased gas mileage, quicker starting, cleaner operating parts within the engine, and most importantly, substantially reduced discharge contaminants from the engine due to the improved combustion process and a fuel saving. The device is readily installed without the use of special tools and due to the absence of moving parts and the protection provided the conductors in the device, essentially no deterioration occurs during its operation. Due to the nature of the construction of the device and the manner in which its several ignition block assemblies are interconnected by the conductors 21 and 22, the device may be readily assembled to function with any number of cylinders by utilizing the required number of induction block assemblies without the necessity of manufacturing and stocking varieties of part sizes and kinds. The uniformity of spark plug lead sizes permits the use of the uniform type induction block assembly with only the number of such assemblies being varied to accommodate the device to various engines having different numbers of cylinders. The use of the two conductive condenser plates in each of the induction assemblies blocks and the difference in the size of the plates which is approximately a ratio of four to one between the large and small plates has been found to produce approximately 40% greater potential at the plates of the non-firing cylinders than has been found to be obtainable with prior art devices including that of the inventor referred to in his previously issued patent.

What is claimed is:

1. An ignition device for improving the combustion process in the combustion chambers of the cylinders of an internal combustion engine having spark plug wires connected between a distributor and the spark plug of each cylinder of said engine, said device comprising: a plurality of separate electrically conductive plates insulated from each other and supported in an assembly means for connection partially around and in insulated relationship with each of said spark plug wires defining a plurality of condenser plates for each of said spark plug wires of an engine for inducing an electrical potential in each of said plates responsive to electrical current flow in one of said spark plug wires through one set of said plates; and a plurality of separate electrical conductors interconnecting corresponding ones of said condenser plates in each of said sets of said plates at all of said spark plug wires, each of said separate conductors and said plates connected with said conductors being insulated from each of the other of said conductors and plates connected with said conductors, whereby current flow through any one of said spark plug wires energizing said wire induces an electrical potential in said plates at said wire and said induced electrical potential is communicated with the remainder of said plates connected with each of said conductors at the non-energized ones of said spark plug wires.

2. An ignition device in accordance with claim 1 wherein each set of said condenser plates adapted to be connected with each of said spark plug wires includes two of said plates and a first of said conductors interconnecting said plates interconnects a first of said plates in each set of said plates and a second of said conductors interconnecting said plates interconnects a second of said plates in each set of said plates.

3. An ignition device in accordance with claim 2 wherein one of said plates is several times as large as another of said plates in each set of said plates.

4. An ignition device in accordance with claim 3 wherein each of said plates is an open-sided channel-shaped member.

5. An ignition device in accordance with claim 4 wherein each set of said plates is supported in a housing provided with a longitudinal channel for receiving a spark plug wire and including a retainer connected with said housing for locking housing on said spark plug wire.

6. An ignition device for conditioning the combustion chambers of internal combustion engines comprising: a plurality of serially interconnected couplers for electrically interconnecting the spark plug wires of said engine, each of said couplers including a first electrically conductive plate adapted to carry an electrical potential responsive to flow of electrical current through the one of said spark plug wires adjacent to said plate, a second electrically conductive plate electrically insulated and spaced from said first plate and adapted to support an electrical potential induced by electrical energy flow through said spark plug wire extending adjacent to said first and second plates, a first electrical conductor interconnecting all of said first plates in parallel, and a second conductor interconnecting all of said second of said plates and electrically insulated from said first conductor whereby energizing any one of said spark plug wires induces an electrical potential on said first and second plates at said wire and said potential is communicatd to the remainder of said first and second plates adjacent the other of said spark plug wires for inducing a potential in said other non-energized spark plug wires.

7. An ignition device in accordance with claim 6 wherein each of said first plates has a surface area several times as large as each of said first plates.

8. An ignition device in accordance with claim 7 wherein each set of said first and second plates is supported in a housing in insulated relationship from each other and said housing has a longitudinal open-sided channel for receiving a spark plug wire and means for clamping said housing on said spark plug wire with said spark plug wire extending through said channel.

9. An ignition device in accordance with claim 8 wherein each of said first and second plates is shaped to partially encompass said channel along said housing whereby said first and second plates of each of said sets is supported partially encompassing a spark plug wire when said housing is secured on said spark plug wire.

10. An ignition device for improving the combustion process in the combustion chambers of the cylinders of an internal combustion engine having a spark plug wire extending from an electrical distributor to each of said cylinders of said engine, said ignition device comprising: a plurality of induction block assemblies and first and second separate electrical conductors interconnecting said induction block assemblies, said induction block assemblies being connected in spaced relation along said first and second conductors between opposite free ends of said first and second conductors, each of said induction block assemblies being adapted to be coupled with a separate one of said spark plug wires and each of said induction block assemblies comprising a housing having substantially parallel opposite end walls and substantially parallel opposite side walls extending between said end walls substantially perpendicular to said walls, a longitudinal semi-elliptical bottom wall extending between said end walls the longitudinal axis of said bottom wall being substantially perpendicular to said end walls, the opposite side edges of said bottom wall being formed integral with the opposite side edges of said side walls, said bottom wall being positioned so that the concave side of said bottom wall opens through the bottom of said housing defining a longitudinal channel to receive a spark plug wire, a hinged retainer secured along one edge with the bottom edge of one of said side walls of said housing and the opposite free edge of said retainer having means for releasably connecting said free edge with the bottom edge of the other of said side walls whereby said hinged retainer is closable across the bottom of said housing to lock said housing on one of said spark plug wires, a partition formed in said housing integral with and extending between said side walls spaced from said end walls connecting with the top surface of said longitudinal bottom wall closely spaced from one of said end walls defining with said end walls said side walls and top surface of said longitudinal bottom wall an upwardly opening first large chamber and an upwardly opening second smaller chamber, each of said chambers extending around said elliptical longitudinal bottom wall encompassing a substantial portion of said downwardly opening channel for said spark plug wire, a removable top connectible along the inside peripheral face of said top with the top edges of said end and side walls of said housing for closing said first and second chambers, said inside face of said top and the top edges of said end side walls having recess openings for lateral access into said first and second chambers of said housing above said longitudinal bottom wall of said housing for extension of said first electrical conductor into said first chamber of said housing and said second electrical conductor into said second chamber of said housing, a first electrically conductive plate positioned in said first chamber of said housing extending along the length of and along the top and sides of said longitudinal bottom wall within said first chamber of said housing and mechanically and electrically connected with said first electrical conductor within said first chamber of said hosing, and a second electrically conductive plate in said second chamber of said housing extending along the length of and around the top and sides of said longitudinal bottom wall of said housing within said second chamber of said housing and electrically and mechanically connected with said second electrical conductor in said second chamber of said housing, said first and second electrically conductive plates being electrically insulated from each other in said housing, said first and second electrical conductors being electrically insulated from each other, said first and second plates in each of said housings being adapted to develop an electrical potential when the spark plug wire extending along said channel of said housing bottom wall is energized, said electrical potential in said first and second plates being electrically communicated to said first and second electrical conductors and further communicated through said electrical conductors to the first and second plates in the induction block on the non-energized spark plug wires imposing said electrical potential on said first and second plates in said induction block assemblies at said non-energized spark plug wires whereby said electrical potential is induced in said non-energized spark plug wires and communicated therethrough to the spark plugs connected with said non-energized spark plug wires for effecting an electrical condition in the combustion chambers in which the non-energized spark plugs are connected for improving combustion conditions of a fuel charge in the non-firing cylinders of said engine preliminary to combustion in said cylinders.

11. An ignition device in accordance with claim 10 wherein each of said first and second electrically conductive plates is a channel-shaped member having a top plate portion having said means for connection with one of said electrical conductors and opposite side wall plate portions substantially parallel with each other and perpendicular to and connected along side edges with said top plate portion defining downwardly opening channel adapted to fit within the appropriate chamber of said housing around said bottom wall of said housing for partially encompassing the spark plug wire passing through said channel formed by said bottom wall of said housing.

12. An ignition device in accordance with any one of claims 1, 2, 3, 4, 5, 6, 7, 8, or 9, wherein each of said electrical conductors interconnecting said condenser plates each connects with one of said condenser plates aligned substantially perpendicular with said spark plug wire associated with said condenser plate.

* * * * *